United States Patent [19]

Cardone

[11] 4,004,095

[45] Jan. 18, 1977

[54] SYSTEM FOR TIME SHARING AN AUDIO AMPLIFIER

[76] Inventor: Vincent Cardone, 28 Peabody Drive, Stowe, Mass. 01775

[22] Filed: Jan. 14, 1975

[21] Appl. No.: 540,954

[52] U.S. Cl. ..... 179/1 GQ; 179/1 G; 179/1 SW; 179/15 A

[51] Int. Cl.[2] ..... H04R 5/00

[58] Field of Search ..... 179/1 GQ, 1 G, 15 BT, 179/15 A, 100.4 ST, 1 SW; 325/36

[56] References Cited

UNITED STATES PATENTS

| | | | |
|---|---|---|---|
| 2,958,857 | 11/1960 | Johnson et al. | 179/15 A |
| 3,158,692 | 11/1964 | Gerkensmeier | 179/15 A |
| 3,566,038 | 2/1971 | Slavin | 179/15 A |
| 3,708,623 | 11/1960 | Dorren | 179/15 BT |
| 3,737,776 | 6/1973 | Fletcher et al. | 179/15 A |
| 3,801,748 | 4/1974 | Cotten | 179/15 A |
| 3,840,705 | 10/1974 | Haskett et al. | 179/15 A |
| 3,852,530 | 12/1974 | Shen | 179/1 GQ |

*Primary Examiner*—Douglas W. Olms
*Attorney, Agent, or Firm*—Evelyn M. Sommer

[57] ABSTRACT

A switching system is described for accepting N-channel audio information and time sharing N/2 amplifiers to drive N-audio speakers. The time sharing switching system includes a timing oscillator, N-channel electronic input switches and an output switching network for coupling between the amplifiers and speakers An arrangement for the elimination of audible noises created by the time sharing system is also disclosed.

10 Claims, 16 Drawing Figures

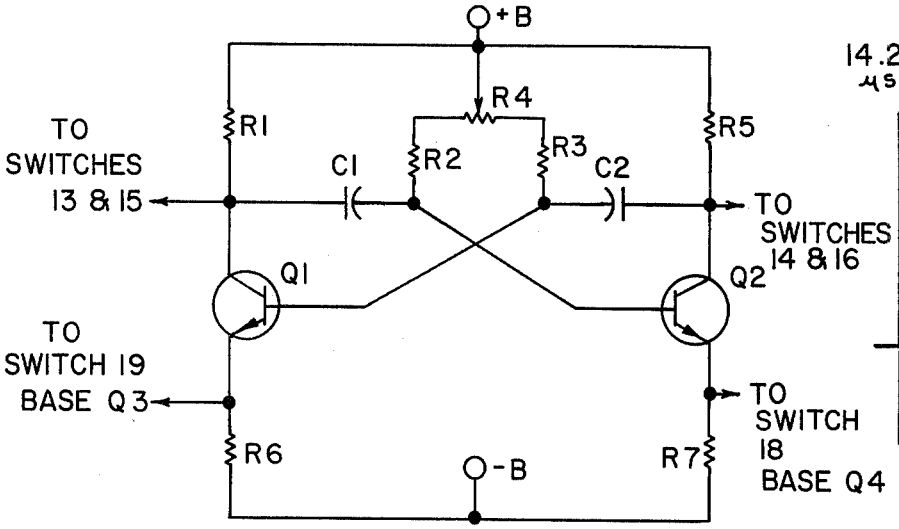
FIG. 2
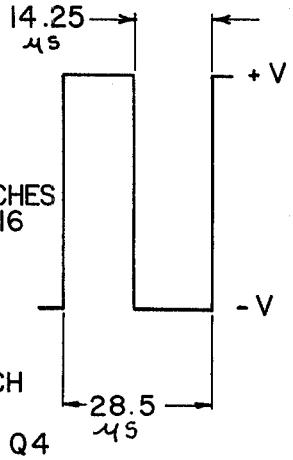
FIG. 2a
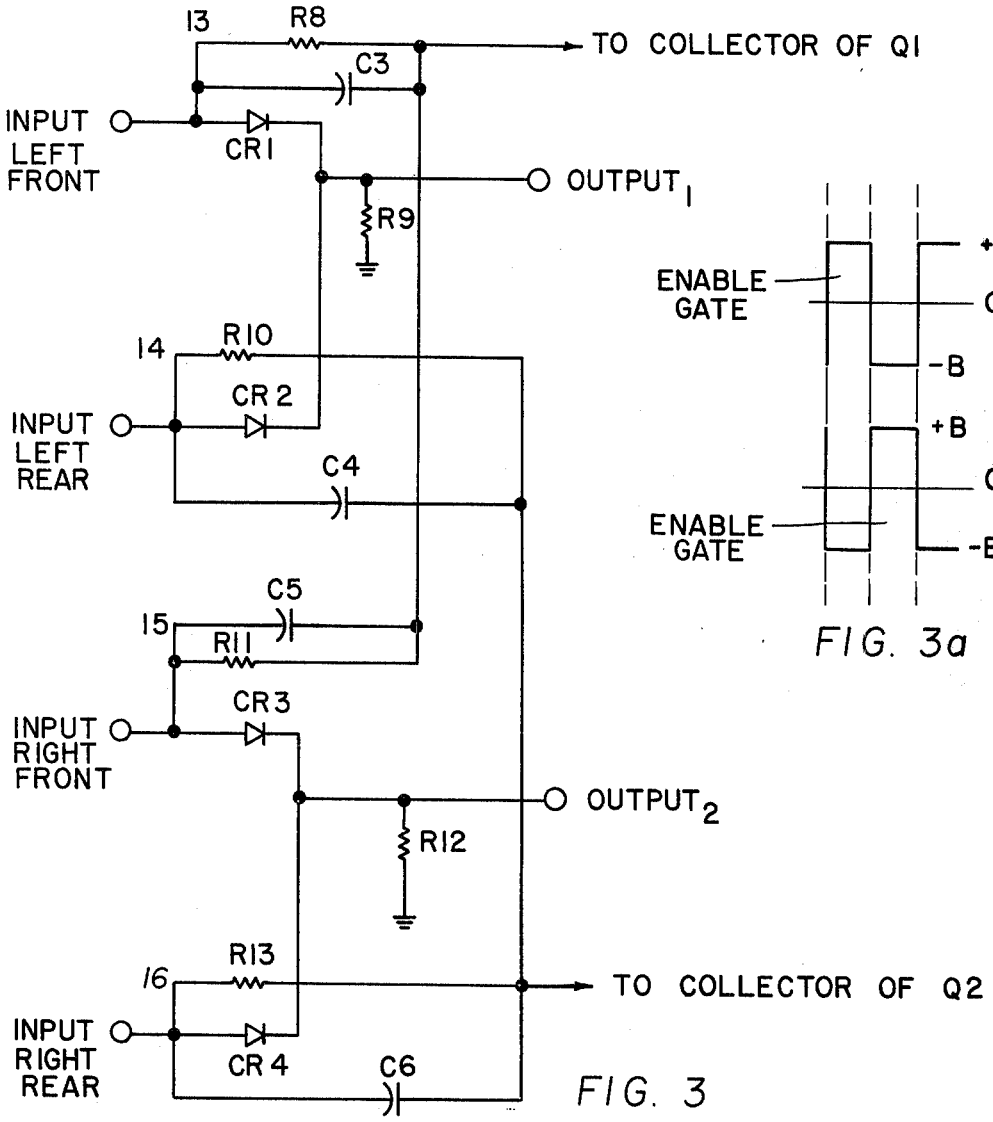
FIG. 3
FIG. 3a

SYSTEM FOR TIME SHARING AN AUDIO AMPLIFIER

FIELD OF THE INVENTION

This invention is related to electronic circuits for use with multi-channel audio systems and, more particularly, to circuits for the time-sharing of amplifiers in a two or four channel system.

BACKGROUND OF THE INVENTION

In recent years, numerous systems have been developed for the reproduction of four-channel or multi-channel sound. These approaches include SQ sound (a CBS development), CD4, and four-channel discrete systems among others.

While there has been increasing interest in quadrophonic systems, a major drawback is the cost differential over stereophonic (two channel) sound. A significant portion of this cost increase results from the need for additional system amplifiers. In all of the systems mentioned above, the additional two-channels of sound requires a second stereo amplifier. This doubles the amplifier cost.

In addition to the increased parts costs, the problems of reliability, cost of labor and general complexity of the multi-channel system mitigate against its widespread acceptance. Thus, a technique which can substantially reduce cost and complexity and increase reliability without sacrificing audio quality is most needed in the multi-channel audio market.

It is accordingly an object of the present invention to provide an audio system for the time sharing of an audio amplifier.

It is an additional object of the present invention to provide a system for the conversion of a single monophonic amplifier into a stereo amplifier with only slightly greater cost than the cost of a monophonic amplifier alone.

It is another object of the present invention to provide a system for the conversion of a stereo amplifier into a four-channel system for less than the cost of a monophonic amplifier.

It is still another object of the present invention to provide a system for time sharing at least one audio amplifier which allows no noticeable deterioration of the reproduced sound.

It is still a further object of the present invention to provide a system for the switching of the speaker coil of a sound system without introducing extraneous audible sound at the speaker output.

It is still an additional object of the present invention to provide a time-sharing audio reproduction system employing an amplifier output stage which is directly coupled to the speaker coil.

These and other objects, as well as numerous advantages of the present invention will be apparent from the following disclosure.

SUMMARY OF THE INVENTION

In accordance with the present invention, a circuit arrangement for time sharing at least one amplifier and at least two speakers is provided having a first and second low level audio signal which is supplied thereto. The arrangement includes means for supplying a first and second gating signal, each having a gating time interval and a blocking time interval, the gating and blocking intervals of the second signal being 180° out of phase with the gating and blocking intervals of the first signal. Means are also included responsive to the first low level signal and the first gating signal for gating the low level signal during the gating intervals of the first gating signal and for blocking the low level signals during the blocking intervals of the first gating signal. The arrangement includes means responsive to the second low level signal and the second gating signal for gating the second low level signal during the gating intervals of the second gating signal and for blocking the second low level signal during the blocking intervals of the second gating signal. Single channel means responsive to the gated portions of the first and second low level signal for amplifying the portions and first and second audio speakers are also included. Finally, the arrangement includes means responsive to the signal developed by the amplifier and the first gating signal for gating the amplified portion of the first low level signal and for supplying the gated amplified signal to the first audio speaker and means responsive to the signal developed by the amplifier and the second gating signal for gating the amplified portion of the second low level signal and for supplying the amplified gated signal to the second audio speaker.

Full understanding of the present invention together with other objects and features thereof will be had by reference to the following description and drawings while the scope of the invention will be pointed out in the appended claims.

BRIEF DESCRIPTION OF THE DRAWINGS

FIG. 2 is a schematic diagram of a timing oscillator which may be used in the block diagram of FIG. 1;

FIGS. 2*a* and 3*a* illustrate a typical oscillator output waveform of the oscillator of FIG. 2;

FIG. 3 illustrates in schematic form the four electronic switches for each of the four inputs which may be used in the FIG. 1 system;

DESCRIPTION OF THE PREFERRED EMBODIMENTS

General Arrangement

Figure 1:
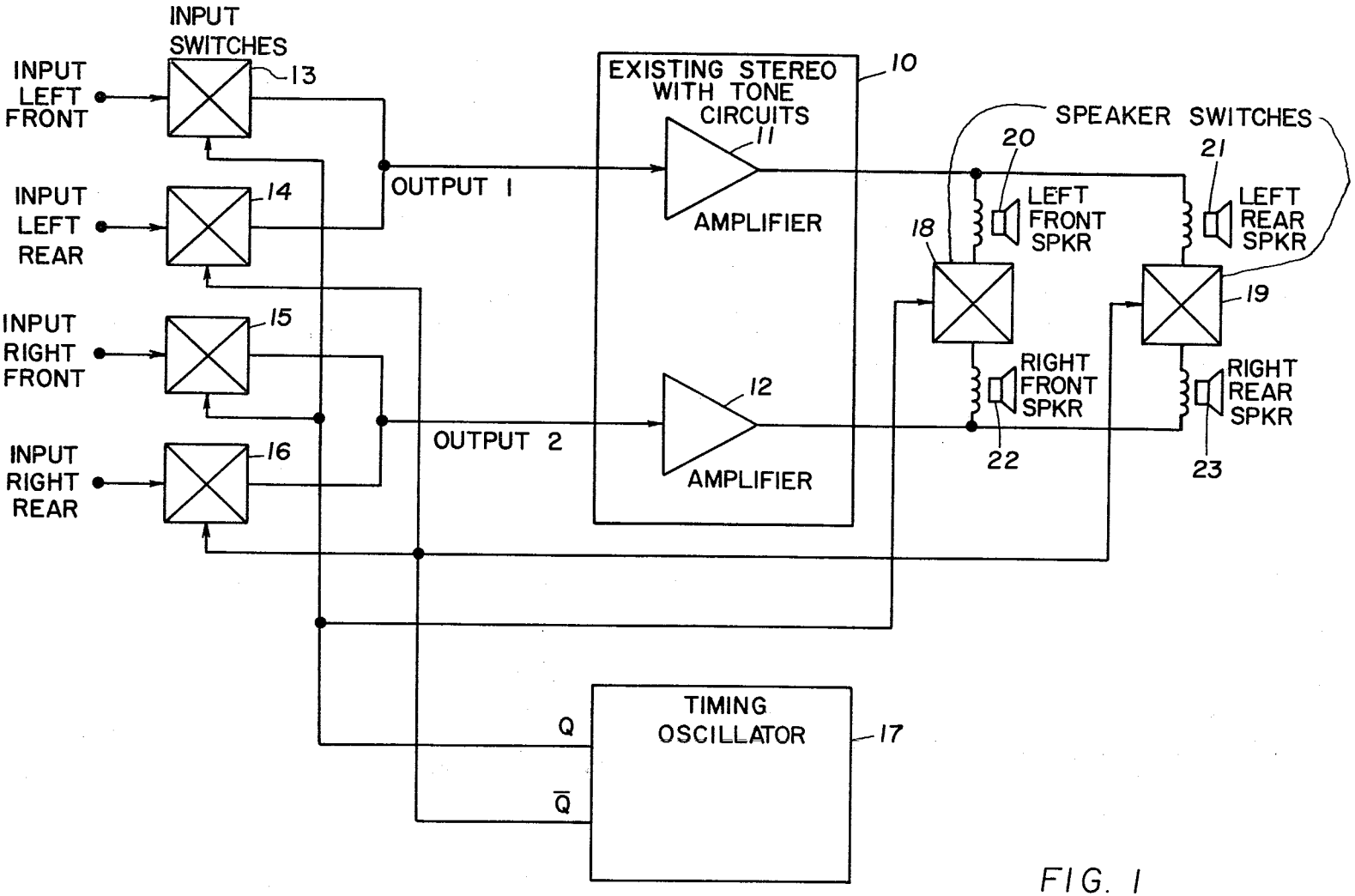
FIG. 1 is a block diagram of a four-channel system employing the time-sharing principle of the present invention.

Referring initially to FIG. 1, a stereophonic amplifier 10 is schematically shown which consists of two individual one-channel amplifiers 11 and 12, the inputs of which are received from paired sets of electronic switches 13, 14 and 15, 16 and the outputs of which are connected via outputs 1 and 2 respectively to four audio speakers 20, 21, 22 and 23 for reproducing four-channel sound. The remaining FIG. 1 circuitry provides a timing oscillator 17 and a pair of gating switches by which the system accepts four-channel input information and by the use of a time sharing approach utilizes only the two amplifiers to provide four-channel output audio signals to drive the speakers.

The four-channel input information may be derived conventionally from a quadrophonic record, four-track tape or any know multi-channel source (not shown). The four input signals are indicated for convenience as "Left Front Input", "Right Front Input", "Left Rear Input" and "Right Rear Input" and are low level audio signals.

The timing oscillator 17 supplies a first and a second gating signal, each having a gating time interval and a blocking time interval respectively indicated as Q and $\overline{Q}$ in the Figure. The gating and blocking times of the second signal are 180° out of phase with the gating and blocking times of the first signal.

Electronic switch 13 includes means responsive to the Left Front Input (LFI) signal and the first gating signal Q for gating the LFI signal during the gating intervals of the first gating signal and for blocking the LFI signal during the blocking intervals of the first gating signal.

Electronic switch 14 includes means responsive to the Left Rear Input signal (LRI) and the second gating signal $\overline{Q}$ for gating the LRI signal during the gating intervals of the second gating signal and for blocking the LRI signal during the blocking intervals of the second gating signal.

The electronic switch 15 includes means which is responsive to the Right Front Input signal (RFI) and the first gating signal for gating the RFI signal during the gating intervals of the first gating signal and for blocking the RFI signal during the blocking intervals of the first gating signal.

The fourth electronic switch 16 functions as means responsive to the Right Rear Input (RRI) signal and the second gating signal for gating the RRI signal during the gating intervals of the second gating signal and for blocking the RRI signal during the blocking intervals of the second gating signal.

The outputs of the electronic switches 13 and 14 are summed and supplied to the input of amplifier 11 while the outputs of electronic switches 15 and 16 which are also summed are supplied to amplifier 12. The amplifier 11 provides means responsive to the gated portions of the LFI and LRI signals for amplifying those portions. Amplifier 12 provides means responsive to the gated portions of the RFI and RRI signals for amplifying those portions.

At the output of the two amplifiers are means shown as electronic switch 18, responsive to the signal developed by amplifier 11 and the first gating signal, for gating the amplified portion of the LFI and LRI signals and for supplying these gated amplified signals to the Left Front speaker 20 and Left Rear speaker 21, respectively. Also shown is electronic switch 19 which functions as means responsive to the signal developed by amplifier 12 and the second gating signal for gating the amplified portion of the RFI and RRI signals to the Right Front speaker 22 and the Right Rear speaker 23.

In operation, timing oscillator 17 provides complementary signals Q and $\overline{Q}$ so that when one signal is high, the second signal is low, and vice versa. Thus, when the $\overline{Q}$ output is high, an enable voltage is supplied simultaneously to electronic switches 13, 15 and 18. This turns each such switch "on" to allow the LFI and RFI information to reach the Left Front speaker and Right Front speaker. When $\overline{Q}$ is high, an enable voltage is supplied simultaneously to electronic switches 14, 16 and 19. This permits the LRI and RRI information to reach the Left Rear speaker and the Right Rear speaker.

The Timing Oscillator

FIG. 2 illustrates the circuit of timing oscillator 17 in detailed schematic form. As shown, the oscillator is a free running astable multivibrator employing transistors $Q_1$ and $Q_2$ as the active elements. The oscillator provides a wave of ideally 50% duty cycle. The output waveform shown in FIG. 2*a* has a period of 28.5 $\mu$ seconds or a 35 kilohertz signal. Capacitors $C_1$, $C_2$ and resistors $R_2$, $R_3$ and $R_4$ set the frequency of the oscillator. Resistors $R_1$, $R_6$, $R_5$ and $R_7$ determine the current and voltage swing of $Q_1$ $Q_2$. The collector of $Q_1$ is coupled to switches 13 and 15; the collector of $Q_2$ is coupled to switches 14 and 16. The emitter of $Q_1$ is coupled to switch 19 and the emitter of $Q_2$ is coupled to the switch 18.

As will be seen hereinafter, in the description of the electronic switches, it is necessary for the gating signal output of the oscillator collectors to swing positive and negative relative to ground or circuit common. To this effect, the oscillator voltage is returned to B+ and B−. With regard to switches 18 and 19, the emitters must swing at least a volt higher than B− for these switches to operate. It is also important from a power consumption viewpoint that the rise and fall times of timing oscillator 17 be as fast as possible. Considering a 28.5 $\mu$sec period, for example, 14.25 $\mu$seconds is allocated for sharing the power load. Thus, a 2 $\mu$second total switching time can result in as much as a 14% power loss to the speakers.

A significant function of the oscillator is that it must be capable of adjustment of switching intervals, i.e., the duty cycle must be able to be adjusted. This is done by potentiometer $R_4$ and protective wing resistors $R_2$ $R_3$. $R_2$ and $R_3$ are fixed resistors of approximately 20% of the value of $R_4$ so as to yield an 80 to 20% duty cycle if desired. The wing resistors $R_2$ and $R_3$ prevent the B+ from appearing directly at the base of $Q_1$ or $Q_2$. The resistor $R_4$ provides a critical adjustment which controls the power distribution. This is effected by changing the duty cycle which in turn controls the balance between front and rear speakers. The relationship of power to duty cycle may be explained as follows: If an amplifier can develop 6.35 volts RMS into an 8 Ω load, the power dissipation is $E^2/R$ or approximately 5 watts. With a 50% duty cycle produced by the timing oscillator output, the power division into two speakers will be 50% or 2.5 watts per speaker (the amplifier will thus never see both loads simultaneously but it will see two 8 Ω loads alternately). Therefore, as $R_4$ is adjusted to vary the duty cycle from 80 to 20%, the power relationship will vary by the same amount or from 4 watts to 1 watt. Consequently, the adjustment of resistor $R_4$, for front and rear speaker balance combined with standard left to right stereo balance provides particularly simple and complete four channel balance (in contrast with complex balancing adjustments in four channel amplifiers).

Input Switching

Referring now to FIG. 3, the detailed construction of electronic switches 13, 14, 15 and 16 is shown. Electronic switch 13 includes a diode $CR_1$, which performs the necessary gating and blocking function. The diode $CR_1$ has its anode connected to the LFI signal and its cathode connected to switch output 1 (which is later coupled to amplifier 11). The first gating signal, which is derived from the collector of $Q_1$ and is shown in the Figure, is coupled to resistor $R_8$. The other side of resistor $R_8$ is connected to the anode of $CR_1$. Capacitor $C_3$ appears in parallel with resister $R_8$. The cathode of $CR_1$ is also connected to resistor $R_9$, the other side of which is connected to ground.

In similar manner, electronic switch 14 includes diode $CR_2$, resistor $R_{10}$, capacitor $C_4$ and resistor $R_9$. The LRI information is supplied to switch 15. It will be seen that resistor $R_9$ serves as a part of both switches 13 and 14 and also serves as a summing point for the output of those switches. Switch 14 is connected to the second gating signal which is coupled from the timing oscillator $Q_2$ collector.

The RFI signal is coupled to switch 15 which includes diode $CR_3$, resistor $R_{11}$, capacitor $C_5$ and resistor $R_{12}$. The output of switch 15 is coupled to switch output 2 which is coupled to amplifier 12, as will be described below. Switch 15 is also connected to the first gating signal.

The RRI signal is supplied to switch 16 which includes diode $CR_4$, resistor $R_{13}$, capacitor $C_6$ and resistor $R_{12}$. $R_{12}$ also functions as part of switch 15 and 16. Switch 16 is also coupled to the second gating signal.

Capacitors $C_3$, $C_4$, $C_5$ and $C_6$ of the various switches are used as speed up capacitors to sharpen the rise time of the gate voltage.

Figure 4:
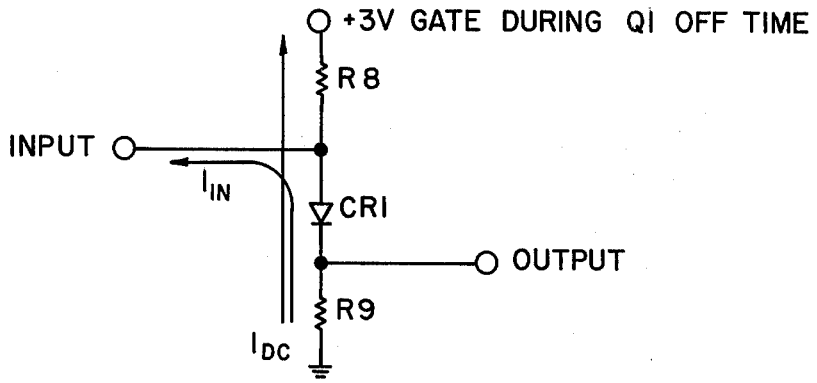
FIG. 4 is an equivalent circuit of one of the electronic switches shown in FIG. 3 illustrating the operation of that switch.

The operation of the electronic switches 13–16 will be described by reference to FIG. 4 which is the equivalent circuit of switch 13. Resistors $R_8$ and $R_9$ are selected to be approximately equal in value. The collectors of $Q_1$ and $Q_2$ of the timing oscillator 17 swing approximately equally positive and negative with respect to ground. During the "off" time of $Q_1$, a positive potential is applied to $R_8$ and a D.C. current ($I_{DC}$) flows through $CR_1$ which turns $CR_1$ on. If an input signal having a similar source impedance as the network is also applied, a second current is set up ($I_{IN}$) in $CR_1$ and $R_9$. Thus, the output taken across $R_9$ will vary as the input voltage and will be superimposed on the D.C. voltage established by $I_{DC}$.

During the time switch 13 is "on", switch 14 is turned "off" as a result of $Q_2$ collector being at a negative potential relative to ground and $CR_2$ being reversed biased. This diode will remain reverse biased for normal signal levels in the order of 200 mv RMS but below 500 mv Peak-to-Peak. If a higher level of input is required, an additional diode in series with $CR_2$ will double the capability of the switch. It is preferred that low capacity signal diodes be used to maintain maximum separation between the channels.

Figure 5:
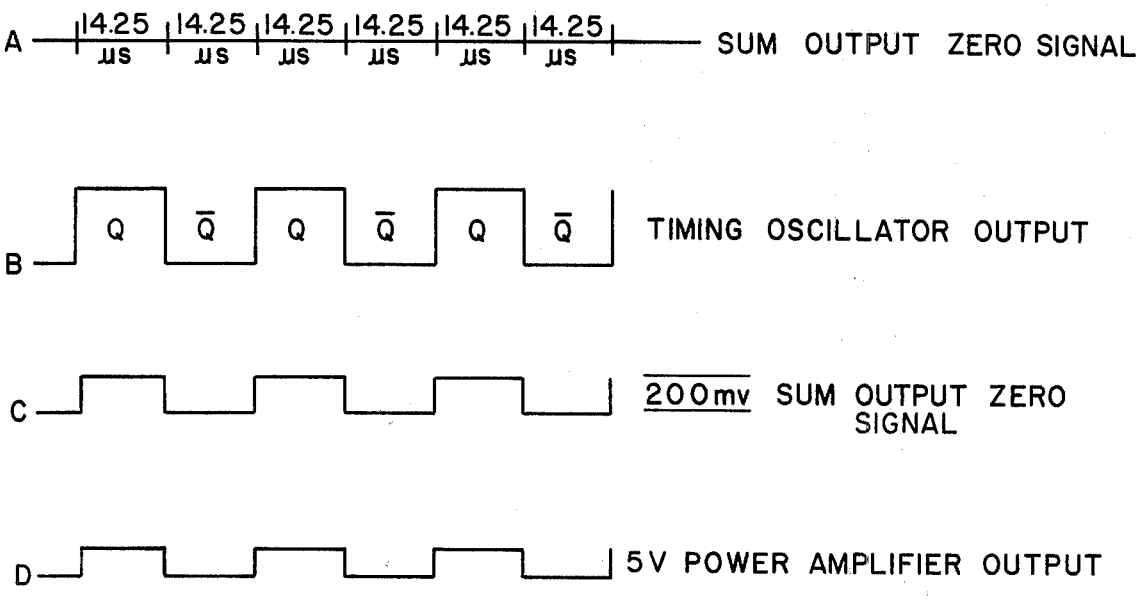
FIG. 5 illustrates the summing output waveforms of the electronic switches under different conditions.

Certain ramifications concerning the switches may be understood by reference to FIG. 5 and waveforms A–D shown therein. The summing point outputs of the switches (output 1 and output 2) should ideally have no pedestal effect. Waveform A illustrates the ideal summing output. Waveform B is the oscillator output from either $Q_1$ or $Q_2$. Waveform A will maintain a good null voltage out of the power amplifier which will idle at a low temperature as a result.

An undesirable summing function output is shown in waveform C. There, a 200 mv Peak-to-Peak signal is developed which, when amplified, results in the 5 VRMS output signal at the power amplifier output. This will cause the amplifier even at zero input signal to run at maximum dissipation.

The pedestal problem described above can be substantially avoided if the switch inputs (e.g., to switches 13 and 14) share the same source impedance.

Amplifier Output Switching

Figure 6:
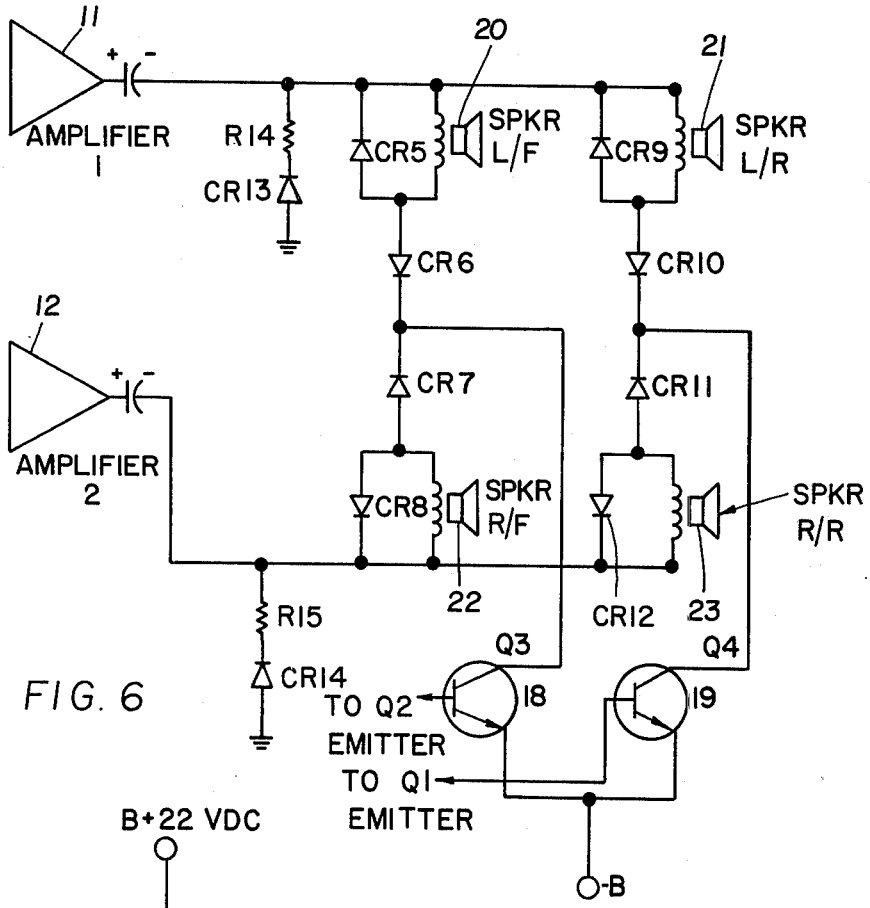
FIG. 6 is a schematic diagram of the switch circuitry between amplifiers and speakers in accordance with the FIG. 1 system.

The amplifier output switching is shown in FIG. 6. Electronic switch 18 comprises transistor $Q_3$ and switch 19 comprises transistor $Q_4$. Each transistor has its emitter connected to the B− voltage. The base of $Q_3$ is driven by the emitter of timing oscillator transistor $Q_2$ and the base of $Q_4$ is driven by the $Q_1$ emitter of the timing oscillator. The collector of $Q_3$ is connected to steering diodes $CR_6$ and $CR_7$; $Q_4$ collector is connected to steering diodes $CR_{10}$ and $CR_{11}$. Across each of the speakers are clamping diodes $CR_5$, $CR_9$, $CR_8$ and $CR_{12}$. Networks $CR_{13}$, $R_{14}$ and $CR_{14}$, $R_{15}$, are connected to amplifier 11 and amplifier 12 outputs respectively.

A significant aspect of the present invention is the provision of necessary circuitry for allowing the speakers to be switched at a very high frequency. Empirical results have shown that maintaining the current uniformly in one direction during one half of the switching period and shorting out the coil of the speaker during the other half to prevent reverse current flow, essentially eliminates ringing. Tests with 8 Ω and 16 Ω voice coils have confirmed this at switching frequencies from 19KHZ to 50 KHZ under positive audio-varying voltages.

In actual tests, speaker response was very good at 30 KHZ. At 19KHZ, an annoying crisp high tone was present which was not present in program information. It was concluded that a first sub-harmonic of 19KHZ was present as a result of the time sharing or a frequency of about 10KHZ. Thus, a time sharing frequency of about 30 KHZ resulted in a first sub-harmonic of about 15KHZ which is just on the upper limit of audible sound. Accordingly, such a time sharing frequency produced no such annoying audible sound.

There is a limit to increasing the time sharing frequency which would certainly push the sub-harmonic completely out of the audible range. The upper limitation results from bandwidth considerations of the time shared amplifier. If the amplifier(s) to be time-shared has a narrow frequency response, integration internal to the amplifier will spoil the separation. Flat setting of the usual tone controls will result in the best frequency response for time sharing purposes.

In operation, the appearance of a voltage about 0.7 more positive than the B− voltage at the base of $Q_3$ will cause $Q_3$ to conduct. Current will flow through $CR_{13}$, $R_{14}$, the coil of left front speaker 20 and diode $CR_6$ to the $Q_3$ collector as well as through diode $CR_{14}$, $R_{15}$, the coil of speaker 22 and diode $CR_7$ to the $Q_3$ collector. This establishes a D.C. bias through the speaker coils about which the information out of the appropriate amplifier will vary.

During the next half cycle, $Q_4$ is "on" and bias current will flow through the coils of the left rear speaker 21 and the right rear speaker 22. When $Q_3$ is "off", diodes $CR_5$ and $CR_8$ prevent reverse current flow through the coils of speaker 20 and 22. Similarly, when $Q_4$ is "off", $CR_9$ and $CR_{12}$ prevent reverse current flowing through speakers 21 and 23. As mentioned previously, diodes $CR_5$, $CR_8$, $CR_9$ and $CR_{12}$ also act as a clamp to prevent speaker ringing.

The $R_{14}$, $CR_{13}$ and $R_{15}$, $CR_{14}$ circuits are used to restore D.C. to the A.C. waveform relative to ground. The A.C. waveform thus remains positive with respect to the B− bias supply on $Q_3$ and $Q_4$ emitters. This enables the switches to turn on by command of the timing oscillator only. The biasing networks defined by $CR_{13}$, $R_{14}$ and $CR_{14}$, $R_{15}$ can be replaced with a speaker, for example, if $CR_{13}$ and $R_{14}$ were so replaced, this speaker would have both L/F information and L/R information present at all times. By adjustment of the power of this auxiliary speaker to ½ power, or equal L/R and L/F speakers, a bias voltage is obtained for output switching and any power loss incurred would be returned to the listener, via the audio signal.

The unidirectional steering diodes $CR_6$, $CR_7$, $CR_{10}$ and $CR_{11}$ are necessary to prevent intermixing of left and right channel information.

Figure 7:
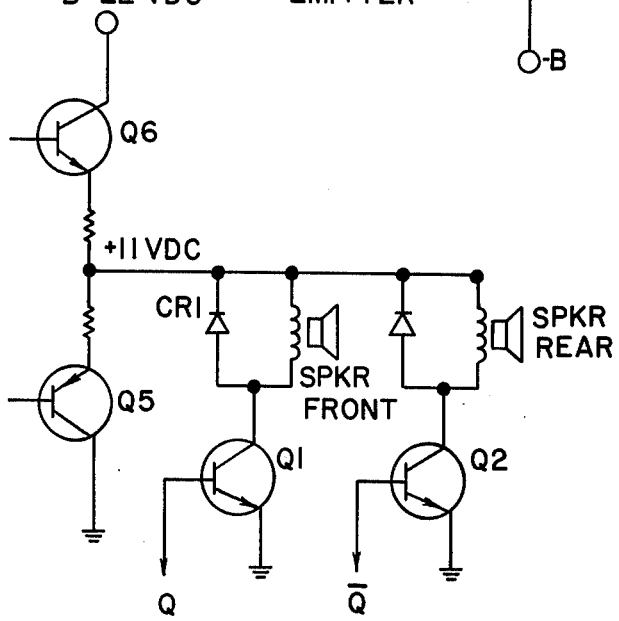
FIG. 7 is a schematic diagram of a modified design of the output stages of the amplifier for use with the present invention.

A variation of the amplifier output stage configuration is shown in FIG. 7. The output stage of the amplifier includes a pair of complementary symmetry transistors, $Q_5$ being a PNP unit and $Q_6$ being an NPN unit. $Q_5$ collector is connected to a B+ potential (e.g. 22 v) and $Q_6$ collector is grounded. This established the output of the amplifier at a positive potential (+11V). The $Q_1$ and $Q_2$ emitters are grounded in this configuration. The nominal D.C. output level of the amplifier maintains the positive bias on the speaker coils. The arrangement of FIG. 7 thus eliminates the coupling capacitor and removes a major limitation in the low frequency response of the amplifier.

The amplifier output stages in the FIG. 7 design will run at a high dissipation even at an idle condition. The $Q_1$ and $Q_2$ transistors however need only be rated at 10% of the power amplifier full rating. This is so because they operate in either saturation or cut-off conditions. Therefore, if the power amplifier develops 5 watts of power into an 8 Ω load, $E2/R=5$, and $E=\sqrt{5\times8}\simeq6.3$ Volts RMS and $I=6.3/8\simeq780$ ma. If $Q_1$ is on, the saturation voltage is about 0.5 V and power dissipation equals $E\times I=0.78\times5=0.39$ watts for 50% of the times or 180 milliwatts for each of $Q_1$ or $Q_2$.

FIG. 7 also illustrates the time sharing of a single amplifier between two speakers. In such design, both switching transistors are still necessary for time sharing operation.

Other variations of the present invention are possible. In some situations, for example, an output power stage for each speaker may be used and switching will occur at the input to each stage.

Figure 8:
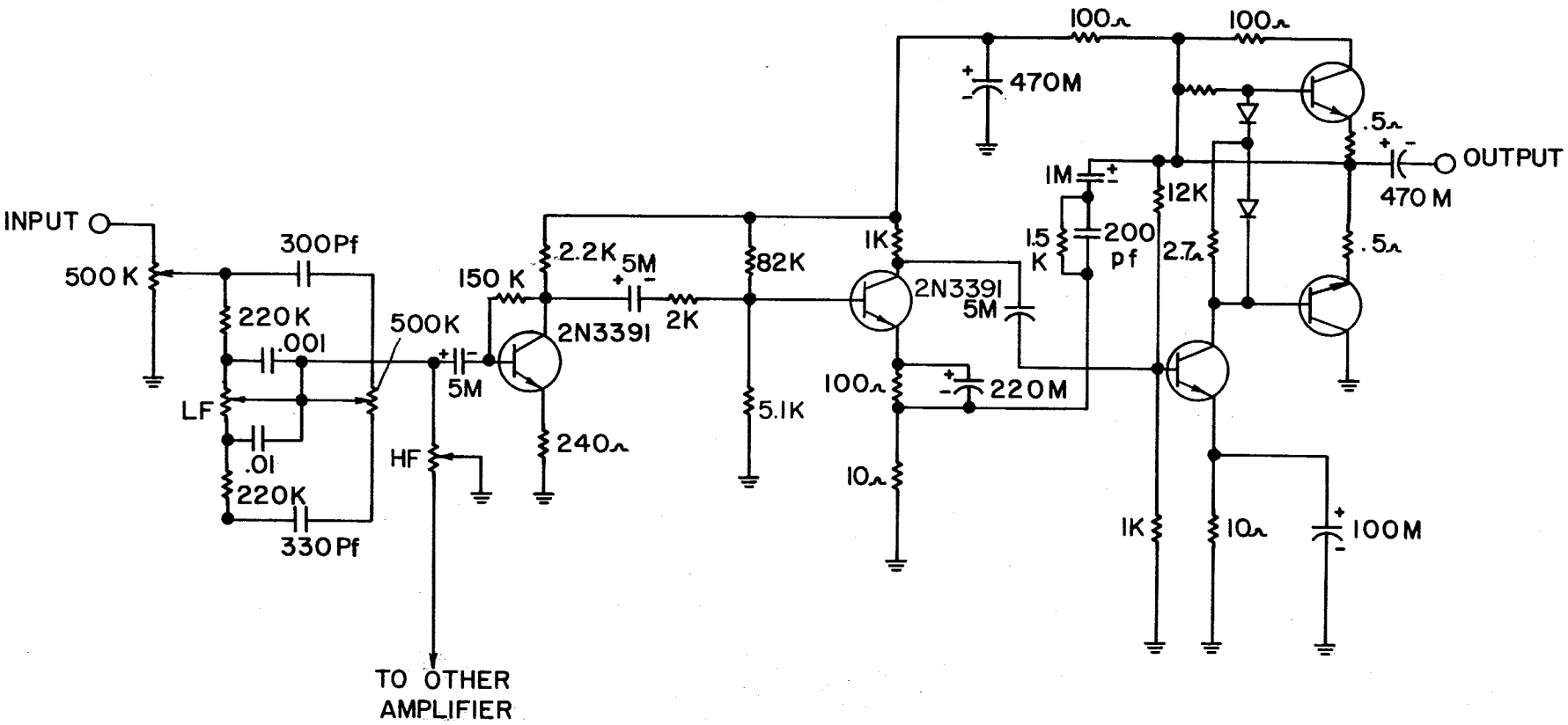
FIG. 8 is a schematic diagram of a standard one-channel amplifier for high fidelity sound reproduction.

FIG. 8 is a standard one channel audio amplifier which may be used as amplifier 11 or 12. The following table represents the typical cost per channel of such an amplifier.

TABLE I

| Component | Cost (in $) |
|---|---|
| Volume Control 500K | .18 |
| Low Freq. Tone Control 500K | .18 |
| High Freq. Tone Control 500K | .18 |
| Balance Control 500K | .18 |
| 19-Resistors ½ watt 10% | .19 |
| 5-Ceramic Caps. | .15 |
| 5-MFD El. Caps. | .17 |
| 1-220 MFD Cap. | .05 |
| 2-100 MFD Caps. | .10 |
| 2-470 MFD Caps. | .36 |

TABLE I-continued

| Component | Cost (in $) |
|---|---|
| 2-Diodes 4001 Type | .14 |
| 2-1 Watt Resistor | .04 |
| 2-Low Pow. 2N3391 | .15 |
| 1-MPS A06 Transistor | .15 |
| 1-PNP Power Trans. | .25 |
| 1-NPN Power Trans. | .22 |
| Total Cost = | $2.69 |

The component cost for a full four channel discrete amplifier system then, $= 4 \times \$2.69 = \$11.76$.

Figure 9:
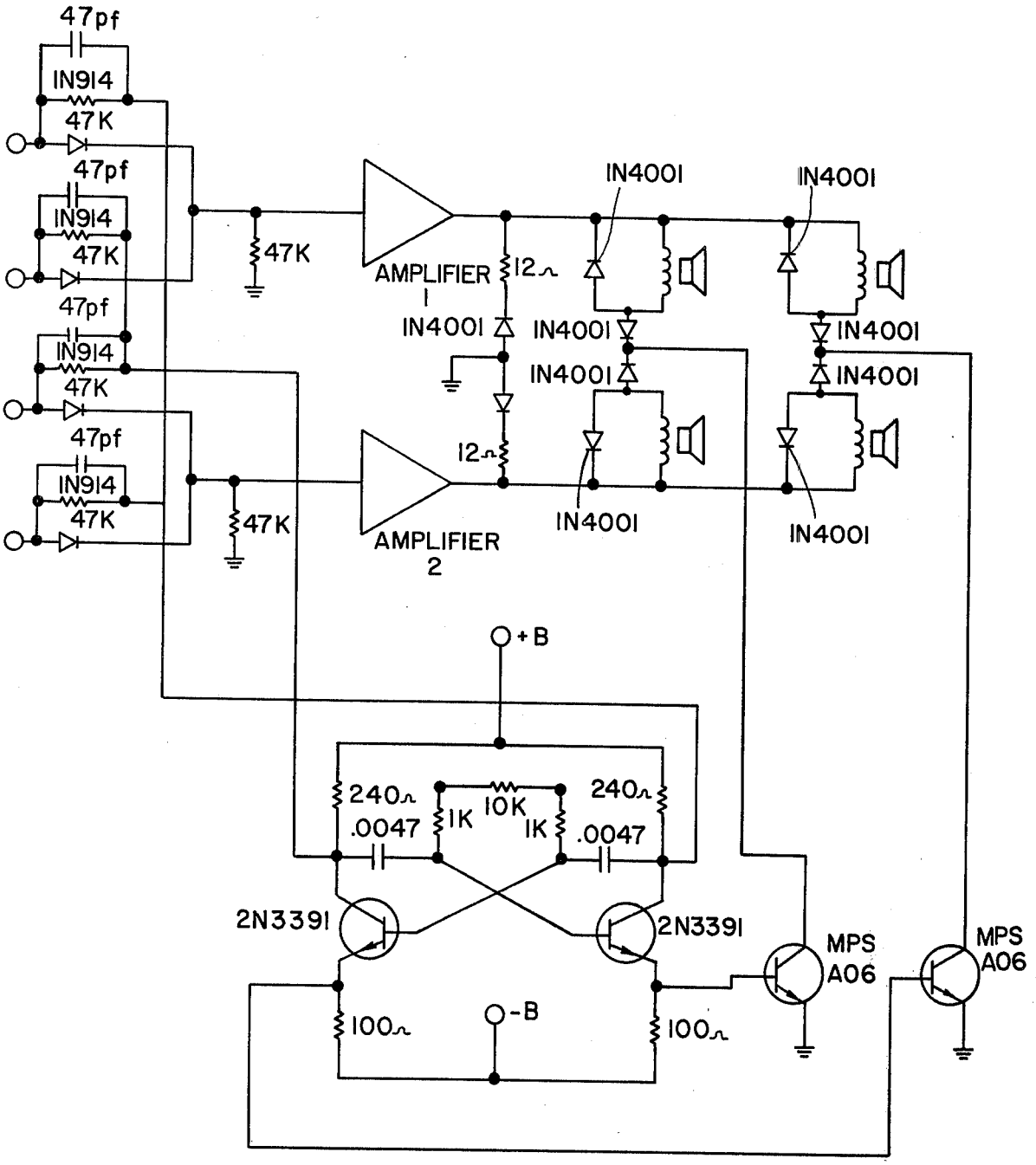
FIG. 9 is a detailed schematic representation of the FIG. 1 arrangement showing the particular parts employed.

For comparison purposes, the full circuit of a time-shared four channel system is shown in FIG. 9. The following table is a total component cost breakdown for a time shared system:

TABLE II

| Component | Cost | |
|---|---|---|
| 12½ W. 10% Res. | .12 | Cost = $1.79 |
| 6-Cer. Caps. | .18 | |
| 10-IN4001 Diodes | .70 | |
| 4-IN914 Diodes | .12 | |
| 2-1 Watt Res. | .04 | |
| 2-2N3391 Trans. | .15 | |
| 2-A06 Trans. | .30 | |
| 1-10K Pot | .18 | |
| 2-STD Amplifiers | 5.38 | |
| Total Cost = | $7.17 | |

From the above comparison, the time shared four channel circuit has been shown to be substantially more economical than a discrete four channel system. A standard 2-channel stereo system could be converted to a four channel system for less than the cost of a single mono-amplifier.

Other aspects of the time sharing system are also significant and are not obvious from the above comparison. The power supply for a four channel discrete system requires four times the power of a single amplifier. The time sharing system, in contrast, requires substantially less power provided that the system time shares the power available by at least a factor of 2, that is the power required for one amplifier (of a two amplifier system) is no more than ½ that of the total capable of delivery. The time shared system requires substantially less labor costs in manufacturing than the discrete system. The switching necessary for a four channel discrete amplifier is very complex and costly and would alone normally cost about $2.00. The cost of input and output jacks is considerable. The printed circuit board is also more costly in the discrete system and are not included in the above comparison.

Figure 10:
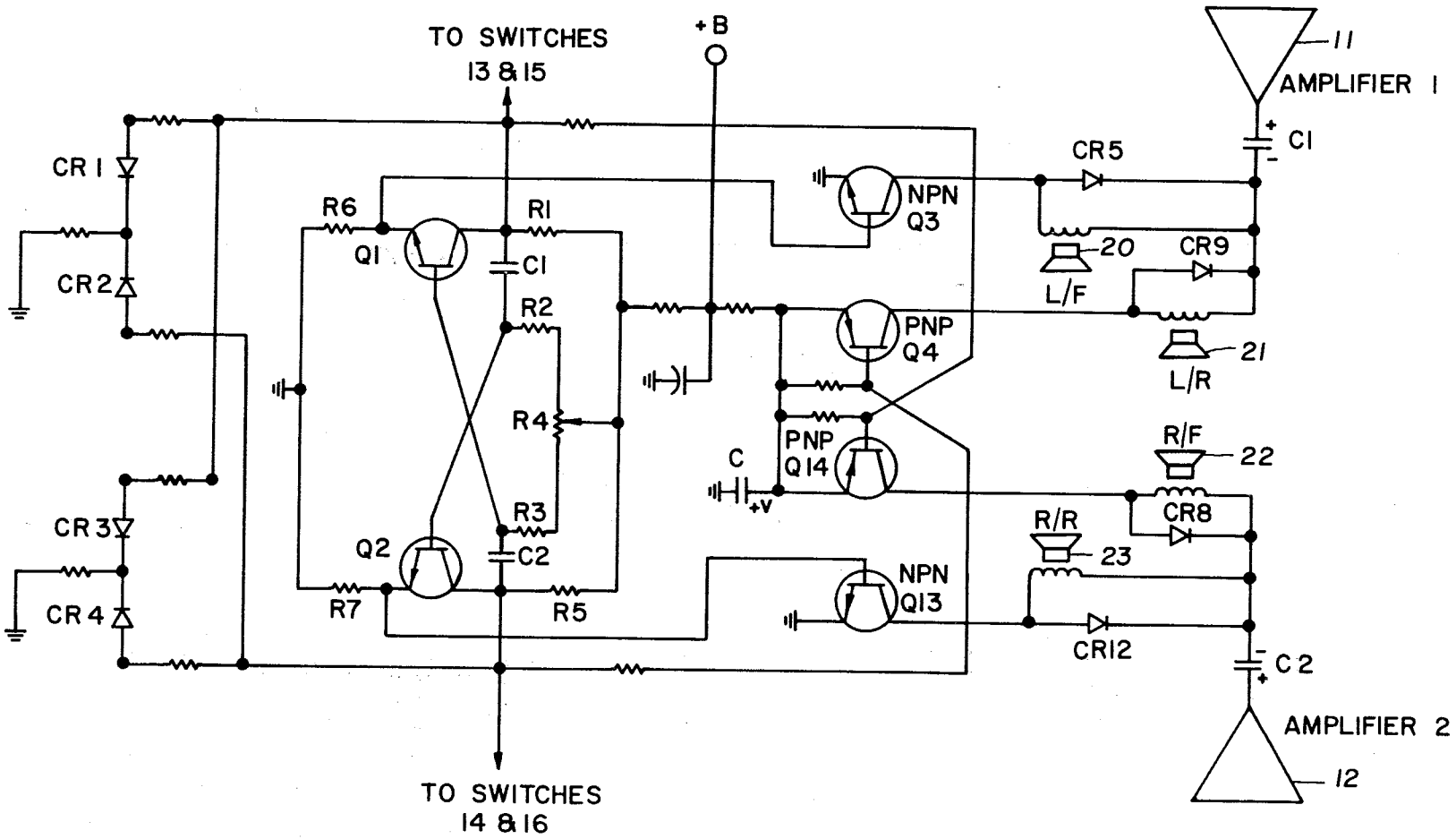
FIG. 10 is a schematic diagram of a system in accordance with the invention wherein a single switching oscillator is divided four times.

It is possible, as seen from FIG. 10, to utilize the foregoing concepts, to provide a system wherein a single switching oscillator is divided four times, alternately applying 25% of its power to each of four speakers. As seen the circuit is similar to that of FIG. 4 with the addition of a pair of transistors $Q_{13}$ and $Q_{14}$, respectively NPN and PNP similar to transistors $Q_3$ and $Q_4$. Transistor $Q_{14}$ is grounded via a capacitor C which alternately see B+ (A.C. ground) and B− (D.C. ground). Thus when $Q_1$ is "on", $Q_3$, $Q_{14}$, $CR_2$ and $CR_4$ turn "on"; and when $Q_2$ is "on" then $Q_4$, $Q_{13}$, $CR_1$ and $CR_3$ are turned "on".

Figure 13:
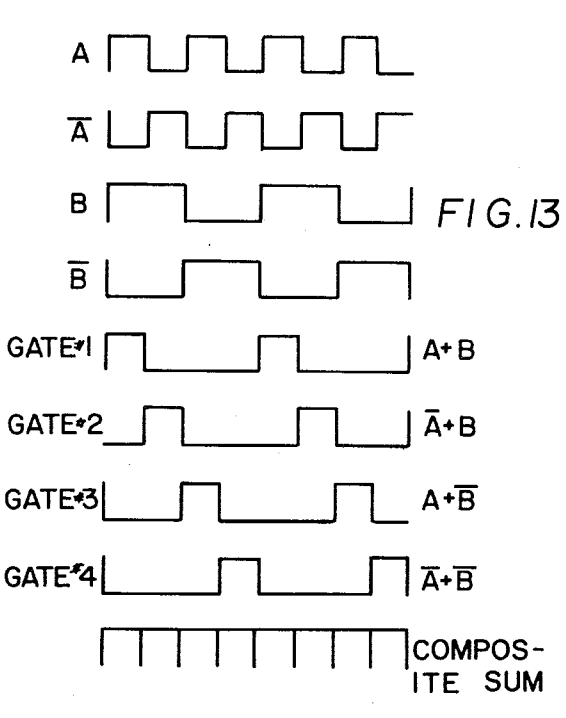
FIGS. 11–14 are illustrations of switching schemes.
Figure 11:
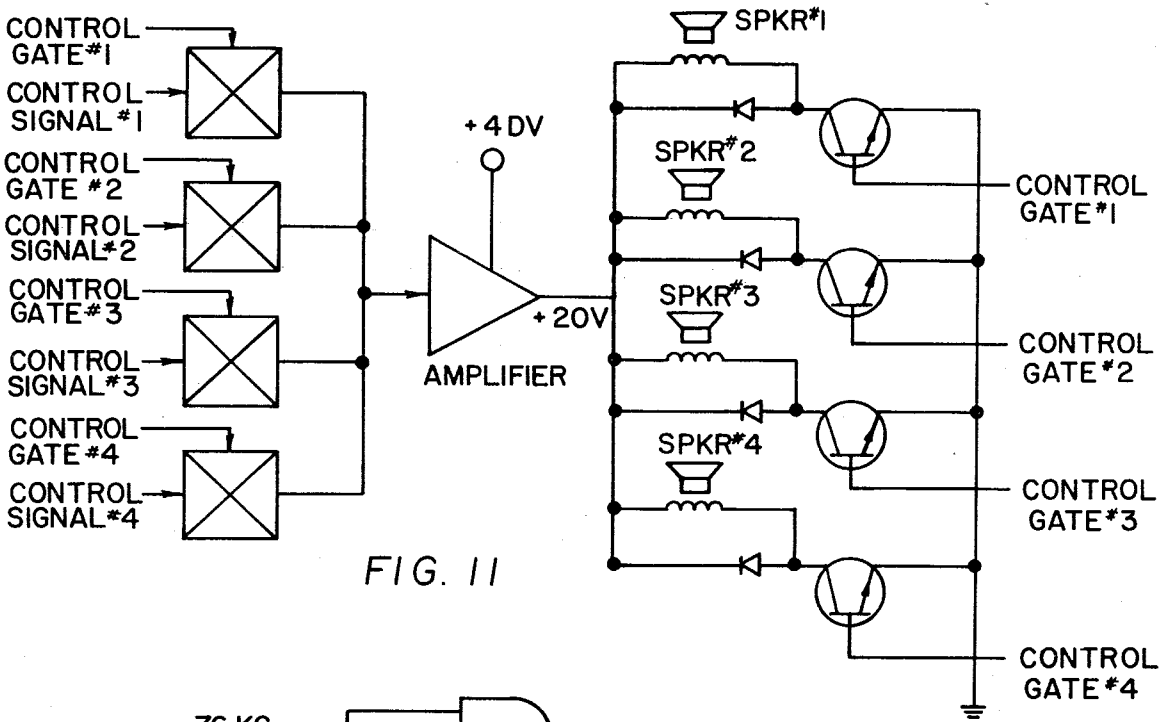
Figure 12:
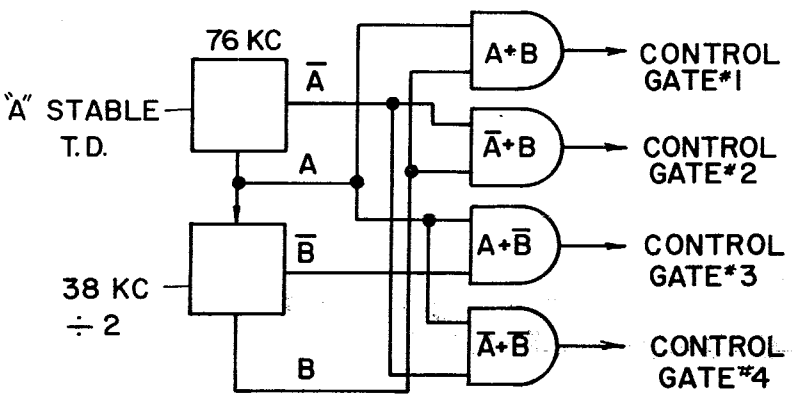

As seen in FIGS. 11–13, during the time interval that $CR_4$ and $CR_2$ are gated "on", $Q_3$ and $Q_{14}$ are also gated "on"; the front loudspeakers are then connected to ground (through $Q_3$ to D.C. ground and through $Q_5$ to ground through capacitor "C"). Simultaneously, $CR_1$, $CR_3$, $Q_{13}$ and $Q_4$ are gated "off". $CR_1$ and $CR_3$ inhibit the signals to the amplifier inputs; $Q_{13}$ and $Q_4$ are non-conducting, and the collectors are held at a positive voltage. The non-conducting state of $Q_{13}$ and $Q_4$ present a high impedance path for the rear speakers to essential grounds. Because of this arrangement, the amplifier always "sees" an 8 ohm impedance to ground.

When using this switching scheme, there is one problem that occurs in the balance circuit. For example, if switching is accomplished from a +10 Volt D.C. potential, and the duty cycle is 50% for both the NPN and PNP transistor switches, the negative side of the capacitor(s) ($C_1$ or $C_2$) will be at a +5VDC potential. This allows a 10 Volt p—p signal swing (+5V peak). Should the amplifier signal output be larger than the +5 Volt operating limit, the signal itself will tend to turn "on" the "off" channel overcoming the time gating T.O. command. The resulting effect is that there is a loss of separation.

When the balance control is moved away from the 50% point, the D.C. operating level (negative sides of $C_1$ and $C_2$) shifts away from the mid-point (+5V) in a direction that is unfavorable for correct balancing, i.e., that the side that more power is desired in, will have less of a swing capability resulting in signal distortion and loss of separation.

This problem is overcome by optimumly selecting the following parameters:

a. Increasing amplifier power supply allows more margin for signal swing without limiting (distortion);

b. shortening the degree of unbalance (balance) so that one side does not appear to be completely cut off.

The rear channels work similarly to the front channels as described earlier, except that $CR_3$, $CR_1$, $Q_4$ and $Q_{13}$ are gated "on" while $CR_4$, $CR_2$, $Q_3$ and $Q_{14}$ are gated "off". This permits alternate operation of the rear channels in response to the stimulus provided by the T.O. commands.

An amplifier with an output capability of 20 watts, whose input/output signals are digitally divided by four, will have four outputs, each one capable of 20 watts/4 or 5 watts per apparent channel. This is brought about by the time division of the input/output signals.

Figure 14:
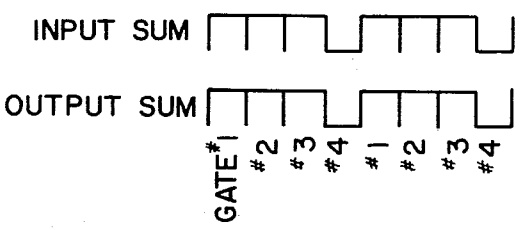

If we apply the same signal to inputs 2, 3, 1, and leave input 4 at zero, we should see at the input/output sum junctions the signals seen in FIG. 14.

In the given case, the amplifier will be delivering 15 watts of power to speakers 2, 3, 1 (5 watts each), speaker 4 will be at zero power.

The foregoing modification lends itself to inexpensive fabrication since a suitable transistor chip design, significantly reducing cost, may be employed.

While the foregoing specification and drawings represent the preferred embodiments of the invention, it will be obvious to those skilled in the art that various changes and modifications may be made therein without departing from the true spirit and scope of the present invention.

Accordingly, the present disclosure should be taken as illustrative only and not as limiting the scope of the invention.

I claim:

1. A circuit arrangement for time sharing at least one amplifier and at least two speakers, said arrangement having a first and second low level audio signal being supplied thereto, said circuit arrangement comprising means interposed between said first and second low level signals for supplying a first and second gating signal of opposite phase; means responsive to the first gating signal and first low level signal for gating said low level signal; means responsive to the second low level signal and the second gating signal for gating said second low level signal; means for amplifying said gated signals; means responsive to the amplified signal and said first gating signal for gating a first portion of said amplified signal to the high side of one of said speakers; and means responsive to the amplified signal and said second gating signal for gating a second portion of said amplified signal to the high side of the other of said speakers said means for gating the respective amplified signals including means for providing alternately a low impedance between the low side of one of the speakers and ground during one portion of a switching period and a high impedance between the low side of the other of the speakers and ground during the same portion of said switching period.

2. A circuit arrangement for time sharing at least one amplifier and at least two speakers, said arrangement having a first and second low level audio signal being supplied thereto, said circuit arrangement comprising means for supplying a first and second gating signal, each having a gating time interval and a blocking time interval, the gating and blocking intervals of said second signal being 180° out of phase with the gating and blocking intervals of said first signal; means interposed between said first and second low level signals and said amplifier responsive to the first low level signal and the first gating signal for gating said low level signal during the gating intervals of said first gating signal and for blocking said low level signal during the blocking intervals of said first gating signal; means responsive to the second low level signal and the second gating signal for gating said second low level signal during the gating intervals of said second gating signal and for blocking said second low level signal during the blocking intervals of said second gating signal; single channel means responsive to the gated portions of said first and second low level signals for amplifying said portions; first and second audio speakers; means responsive to the signal developed by said amplifier and the first gating signal for gating the amplified portion of said first low level signal and for supplying said gated amplified signal to the high side of said first audio speaker; and means responsive to said signal developed by said amplifier and the second gating signal for gating the amplified portion of said second low level and for supplying said amplified gated signal to the high side of said second audio speaker, said means for gating the respective amplified signals including means for providing a low impedance between the low side of the speaker and ground during one portion of a switching period and a high impedance between the low side of the speaker and ground during another portion of said switching period.

3. The circuit arrangement of claim 2, wherein each of said gating means responsive to said amplified signal also includes means for blocking from one speaker the portion of said amplified signal being supplied to the other speaker.

4. The circuit arrangement of claim 2, also including means for supplying a D.C. bias current to each speaker coil during a portion of the time sharing period and means for shorting each speaker coil during another portion of the period.

5. The circuit arrangement of claim 2, wherein said gating signals have a frequency of at least 30 KHZ.

6. The circuit arrangement of claim 2, including a second means for amplifying a third and fourth audio signal and wherein a third and fourth low level signal is supplied thereto, said arrangement also including means responsive to the third low level signal and the first gating signal for gating the third low level signal during the gating intervals of said first gating signal and for blocking said third low level signal during the blocking intervals of said first gating signal; means responsive to the fourth low level signal and the second gating signal for gating the fourth low level signal during the gating intervals of said second gating signal and for blocking said fourth low level signal during the blocking intervals of said second gating signal; means for summing the outputs of the first and third low level signal gating means and for supplying said summed signal to said first amplifying means; means for summing the outputs of the second and fourth low level signal gating means and for supplying said summed signal to said second amplifying means; wherein said means responsive to the amplified signal also includes means for gating the amplified portions of the sum of the first and third low level signal and for supplying said gated amplified signal to the first and third audio speakers and means for gating the amplified portion of the sum of the second and fourth low level signals and for supplying said gated amplified signals to the second and fourth audio speakers.

7. The circuit arrangement of claim 6, also including means for supplying a D.C. bias current to each speaker coil during a portion of the time sharing period and means for clamping each speaker coil during another portion of the period.

8. The circuit arrangement of claim 6, wherein said gating signals have a frequency of at least 30 KHZ.

9. A circuit arrangement for the suppression of induced noise caused by periodic switching of a speaker having a speaker coil, said circuit arrangement comprising means for supplying a high level signal to the high side of said speaker coil; means for providing a low impedance between the low side of the coil and ground during one portion of a switching period and a high impedance between the low side of the coil and ground during another portion of said switching period; means for providing a biasing current to said speaker coil during the portion of said switching period in which the low side of the coil is grounded through a low impedance; and means for preventing reverse current flow in said speaker coil during the portion of said switching period in which the low side of the coil is grounded through a high impedance.

10. The circuit arrangement of claim 9, wherein the means for supplying a high and low impedance is a transistor switch, said biasing current being supplied by a D.C. potential in series with the output electrodes of said transistor and said means for preventing reverse current flow through the speaker coil includes a clamping diode connected across the coil.

* * * * *